US010777911B2

(12) United States Patent
Tamura et al.

(10) Patent No.: US 10,777,911 B2
(45) Date of Patent: Sep. 15, 2020

(54) ELECTRIC CABLE CONNECTING TERMINAL AND METHOD FOR CONNECTING TOGETHER ELECTRIC CABLE CONNECTING TERMINAL AND ELECTRIC CABLE

(71) Applicant: TABUCHI ELECTRIC CO., LTD., Osaka (JP)

(72) Inventors: Akimasa Tamura, Osaka (JP); Atsushi Kawabata, Osaka (JP); Kazusa Mori, Osaka (JP); Kazuhiro Matsui, Osaka (JP)

(73) Assignee: TABUCHI ELECTRIC CO., LTD., Osaka (JP)

( * ) Notice: Subject to any disclaimer, the term of this patent is extended or adjusted under 35 U.S.C. 154(b) by 186 days.

(21) Appl. No.: 15/573,636

(22) PCT Filed: May 16, 2016

(86) PCT No.: PCT/JP2016/064512
§ 371 (c)(1),
(2) Date: Nov. 13, 2017

(87) PCT Pub. No.: WO2016/182084
PCT Pub. Date: Nov. 17, 2016

(65) Prior Publication Data

US 2018/0151962 A1 May 31, 2018

(30) Foreign Application Priority Data

May 14, 2015 (JP) ..... 2015-099051

(51) Int. Cl.
*H01R 4/02* (2006.01)
*H01R 4/18* (2006.01)
(Continued)

(52) U.S. Cl.
CPC ..... *H01R 4/023* (2013.01); *H01R 4/184* (2013.01); *H01R 4/187* (2013.01); *H01R 4/625* (2013.01);
(Continued)

(58) Field of Classification Search
CPC . H01R 4/02; H01R 4/023; H01R 4/18; H01R 4/184; H01R 4/187; H01R 4/62;
(Continued)

(56) References Cited

U.S. PATENT DOCUMENTS 3,777,302 A * 12/1973 Travis ..... H01R 13/567 439/854
9,065,188 B2 6/2015 Liegl et al.
(Continued)

FOREIGN PATENT DOCUMENTS

CN 101659935 A 10/2010
CN 101859935 A 10/2010
(Continued)

OTHER PUBLICATIONS

International Search Report (English version) dated Jul. 26, 2016 from corresponding International Application No. PCT/JP2016/064512 (1 page).
(Continued)

*Primary Examiner* — Timothy J Thompson
*Assistant Examiner* — Guillermo J Egoavil
(74) *Attorney, Agent, or Firm* — Maier & Maier, PLLC

(57) ABSTRACT

Provided are an electric cable connecting terminal reducing unwanted overflow of solder out of an electric cable connecting portion to a connector portion during soldering, and a method for joining an electric cable connecting terminal and an electric cable. An electric cable connecting terminal for electrically connecting an electric cable to an external conductor includes a connector portion to be attached to the
(Continued)

conductor, and an electric cable connecting portion having a connecting surface to which the electric cable, which is a bundle of core wires, is connected by soldering. The electric cable connecting portion includes a crimp portion to be swaged to hold the electric cable, and a step portion protruding from the connecting surface between the connector portion and the crimp portion.

9 Claims, 5 Drawing Sheets

(51) Int. Cl.
*H01R 4/62* (2006.01)
*H01R 43/02* (2006.01)
*H01R 43/048* (2006.01)
*H01R 11/12* (2006.01)

(52) U.S. Cl.
CPC ..... *H01R 11/12* (2013.01); *H01R 43/02* (2013.01); *H01R 43/0263* (2013.01); *H01R 43/048* (2013.01); *H01R 4/62* (2013.01)

(58) Field of Classification Search
CPC ..... H01R 4/625; H01R 4/185; H01R 11/12; H01R 13/03; H01R 13/567; H01R 13/432; H01R 43/02; H01R 43/0263; H01R 43/048; H01R 43/16
USPC ..... 174/84 C; 339/223 R; 439/877
See application file for complete search history.

(56) References Cited

U.S. PATENT DOCUMENTS

2010/0035486 A1* 2/2010 Tabata ..... H01R 4/185 439/877
2013/0118804 A1 5/2013 Liegl et al.
2013/0225014 A1* 8/2013 Sato ..... H01R 4/70 439/736
2013/0344723 A1* 12/2013 Peters ..... H01R 4/203 439/275
2016/0172769 A1* 6/2016 Kamoshida ..... H01R 4/62 439/877

FOREIGN PATENT DOCUMENTS

CN 103026553 A 4/2013
JP H04-43857 U 4/1992
JP 08241744 A * 9/1996 ..... H01R 11/11
JP H08241744 A * 9/1996 ..... H01R 11/11
JP 10-289745 10/1998
JP 2010009794 A * 1/2010 ..... H01R 43/02
JP 2014-157716 A 8/2014
JP 2014157716 A * 8/2014 ..... H01R 4/02
JP 2006-286385 A 10/2016

OTHER PUBLICATIONS

Chinese Office Action dated Nov. 5, 2018, in connection with corresponding CN Application No. 201680026695.8 (12 pgs., including machine-generated English translation).
Japanese Office Action dated May 14, 2019, in connection with corresponding JP Application No. 2015-099051 (6 pgs., including machine-generated English translation).
Japanese Office Action dated Sep. 3, 2019, in connection with corresponding JP Application No. 2015-099051 (7 pgs., including machine-generated English translation).
Chinese Office Action dated Oct. 9, 2019, in connection with corresponding CN Application No. 201680026695.8 (11 pgs., including machine-generated English translation).

* cited by examiner

ELECTRIC CABLE CONNECTING TERMINAL AND METHOD FOR CONNECTING TOGETHER ELECTRIC CABLE CONNECTING TERMINAL AND ELECTRIC CABLE

RELATED APPLICATIONS

This application claims priority to Japanese Patent Application No. 2015-099051 filed on May 14, 2015, the entire disclosure of which is incorporated by reference herein.

TECHNICAL FIELD

The present invention relates to electric cable connecting terminals for electrically connecting an electric cable to an external conductor, and also relates to a method for joining an electric cable connecting terminal and an electric cable.

BACKGROUND

In the known art, to electrically connect an electric cable (e.g., for a power supply) to an electric terminal (a conductor) of an external power supply or a rotating machine, an electric cable connecting terminal is joined to an end portion of the electric cable, and, for example, is attached to a screw opening of the electric terminal with a screw turned into a screw hole thereof. The electric cable connecting terminal is joined to the electric cable by, e.g., soldering. Examples of such an electric cable connecting terminal include a terminal disclosed in Patent Document 1. This terminal includes a connector portion having an attachment hole for attaching the terminal to the external conductor, and a cylindrical electric cable connecting portion to which an electric cable can be soldered.

PATENT DOCUMENT1: Japanese Unexamined Patent Publication No. 2006-286385

SUMMARY OF THE INVENTION

However, the solder overflows out of the electric cable connecting portion to the connector portion unexpectedly during soldering. If the overflowed solder partially overlaps with the connector portion, the connector portion and the external conductor do not make a sufficiently close contact with each other when the connector portion is attached to the external conductor with a screw turned into a screw hole thereof. This may cause an insufficient electrical junction therebetween.

It is therefore an object of the present invention to provide an electric cable connecting terminal that can reduce such overflow of solder out of an electric cable connecting portion to a connector portion during soldering, and a method for joining an electric cable connecting terminal to an electric cable.

To achieve the object, the electric cable connecting terminal of the present invention is an electric cable connecting terminal for electrically connecting an electric cable to an external conductor, the electric cable connecting terminal comprising: a connector portion to be attached to the conductor, and an electric cable connecting portion having a connecting surface to which an electric cable, which is a bundle of core wires, is connected by soldering, wherein the electric cable connecting portion includes: a crimp portion to be swaged to hold the electric cable; and a step portion protruding from the connecting surface between the connector portion and the crimp portion. The core wires may be solid wires or stranded wires.

According to the present invention, provided is the step portion protruding from the connecting surface between the connector portion to be attached to the conductor and the crimp portion holding the electric cable soldered to the connecting surface. This can reduce unwanted overflow of solder out of the electric cable connecting portion to the connector portion during soldering. Moreover, when the electric cable includes an end portion that is in contact with the step portion or that is provided near the step portion, the solder which has adhered to the end portion of the electric cable during soldering also adheres to the step portion. This can further strengthen the bond between the electric cable and the electric cable connecting terminal. Thus, the electric cable and the electric cable connecting terminal, which are made of different materials, are firmly soldered, while this soldering is regarded as difficult in general.

The electric cable connecting portion preferably includes an extending portion extending opposite to the step portion with respect to the crimp portion. In soldering, the solder may run along the electric cable connecting portion to overflow opposite to the step portion with respect to the crimp portion. However, the extending portion extending opposite to the step portion with respect to the crimp portion is provided. Thus, even if the solder flows from the crimp portion to the step portion, the extending portion can avoid overflow of the solder from the electric cable connecting portion. Moreover, this can stabilize the bond between the electric cable connecting terminal and the electric cable.

In the electric cable connecting terminal, preferably, the electric cable is made of aluminum or an aluminum alloy, the electric cable connecting terminal is made of copper or a copper alloy which is a material different from that of the electric cable, and a tinning treatment for avoiding electric corrosion is applied on at least the connecting surface. For example, while an electric cable made of copper or an copper alloy is used in many cases, aluminum or an aluminum alloy has good conductivity, and is more lightweight and inexpensive than, e.g., copper. Thus, the electric cable made of, e.g., aluminum has many advantages. Thus, when the electric cable made of aluminum or an aluminum alloy is joined to the electric cable connecting terminal made of a different material such as copper or a copper alloy, electric corrosion may occur between the electric cable and the electric cable connecting terminal to cause corrosion of the electric cable. However, even if the electric cable is made of aluminum or an aluminum alloy and the electric cable connecting terminal is made of copper or a copper alloy, the above configuration can avoid the electric corrosion, and also strengthen the mechanical junction and stabilize the electrical junction between the electric cable and the terminal, because a tinning treatment for avoiding electric corrosion is applied on at least the connecting surface to which the electric cable is soldered.

Preferably, the crimp portion includes a first crimp piece to be swaged to hold the electric cable under a stress condition where a first external force is applied, and a second crimp piece to be swaged to cover the electric cable under a non-stress condition where no external force is applied, both the crimp pieces are spaced apart with a predetermined gap in a longitudinal direction of the electric cable connecting portion, under the stress condition where the first external force is applied by the first crimp piece, the electric cable connecting terminal and the electric cable are electrically joined, and under the non-stress condition of the second crimp piece, the electric cable connecting terminal and the electric cable are mechanically joined by soldering.

According to the above configuration, the first crimp piece is swaged to hold the electric cable under the stress condition where the first external force is applied. Thus, the core wires come to have their bonding density increased, and the electric cable and the electric cable connecting terminal are joined in an electrically stable manner. In addition, the electric cable covered by the second crimp piece is soldered under the non-stress condition. Thus, the solder penetrates into the gaps among the core wires near the outer peripheral surface of the electric cable. This enhances the bonding strength between the electric cable's outer peripheral surfaces and the electric cable connecting terminal. Then, this strengthens the mechanical junction between the electric cable connecting terminal and the electric cable.

In the configuration with the first crimp piece and the second crimp piece, preferably, the first and second crimp pieces swaged each include an electric cable housing portion into which the electric cable is inserted, a cross-sectional area of the electric cable housing portion of the first crimp piece is smaller than that of the electric cable outside the electric cable housing portion, and a cross-sectional area of the housing portion of the second crimp piece is larger than that of the electric cable outside the electric cable housing portion. In this case, the second crimp piece can be easily swaged to cover the electric cable with no external force applied to the electric cable in a state in which the first crimp piece is swaged to hold the electric cable under the stress condition.

In the configuration with the first crimp piece and the second crimp piece, the second crimp piece may include one or more through portions passing through the second crimp piece in a direction orthogonal to the electric cable. That is, the through portions of the second crimp piece allow the flux and solder to flow smoothly to enhance the bonding strength. The electric cable connecting portion may include a protruding portion protruding from the connecting surface. This protruding portion (such as an upright cut member formed by making the section of the electric cable connecting portion stand upright) increases the area of contact between the crimp piece and the core wires to further enhance the bonding strength of soldering.

To achieve the object, the method of the present invention for joining an electric cable connecting terminal and an electric cable is a method for joining an electric cable to the electric cable connecting terminal including the first crimp piece and the second crimp piece, the method comprising: an electrical joining step of swaging the first crimp piece and electrically joining the electric cable connecting terminal and the electric cable under the stress condition where the first external force is applied to the electric cable by the first crimp piece, and a mechanical joining step of swaging and bringing the second crimp piece toward the electric cable with no external force applied to the electric cable; energizing a first heating electrode for heating the second crimp piece; heating the electric cable under the non-stress condition, supplying flux and solder to the electric cable through a gap between the second crimp piece and the electric cable; and mechanically joining the electric cable and the electric cable connecting terminal by soldering the electric cable to the electric cable connecting terminal.

According to this method, the first crimp piece is swaged to hold the electric cable under the stress condition where the first external force is applied. Thus, the core wires come to have their bonding density increased, and the electric cable and the electric cable connecting terminal are joined in an electrically stable manner. In addition, the electric cable covered by the second crimp piece is heated by energization to the first heating electrode and soldered to the electric cable connecting terminal under the non-stress condition where no external force is applied. Thus, the solder supplied through the gap between the electric cable and the second crimp piece penetrates into the gaps among the core wires near the outer peripheral surface of the electric cable. This enhances the bonding strength between the electric cable's outer peripheral surfaces and the electric cable connecting terminal. Then, this strengthens the mechanical junction between the electric cable connecting terminal and the electric cable.

The mechanical joining step includes: heating the electric cable between the first crimp piece and the second crimp piece with a second external force applied thereto by a second heating electrode; and using the flux and solder supplied to the gap and flowed to the electric cable to solder the core wires of the electric cable between both the crimp pieces. In this case, the core wires can be soldered together with the second external force applied between the crimp pieces. Thus, the electric cable and the electric cable connecting terminal can be more firmly mechanically joined.

Any combination of at least two configurations disclosed in the claims and/or the specification and/or the drawings falls within the present invention. In particular, any combination of two or more of the claims falls within the present invention.

BRIEF DESCRIPTION OF THE DRAWINGS

The present invention will be more clearly understood from the description of preferable embodiments described below with reference to the drawings. However, the embodiments and drawings are merely illustrative, and should not be used to define the scope of the present invention. The scope of the present invention is defined by the attached claims. In the attached drawings, the same reference characters in different drawings designate the same or corresponding portions.

DETAILED DESCRIPTION OF THE INVENTION

Figure 1:
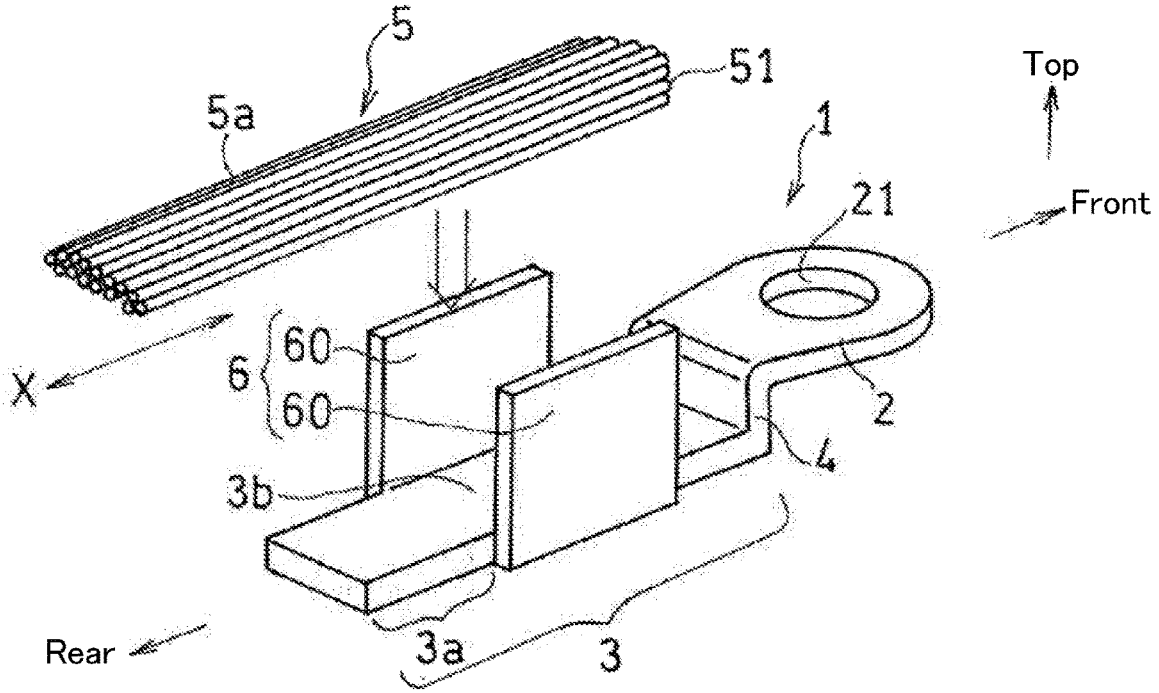
FIG. 1 is an exploded perspective view of an electric cable connecting terminal of a first embodiment of the present invention.

Embodiments of the present invention will be described below with reference to the drawings. Note that the same reference characters in different drawings designate the same or corresponding portions, and the descriptions thereof will be omitted unless there is need for describing a significant variation etc.

Figure 2:
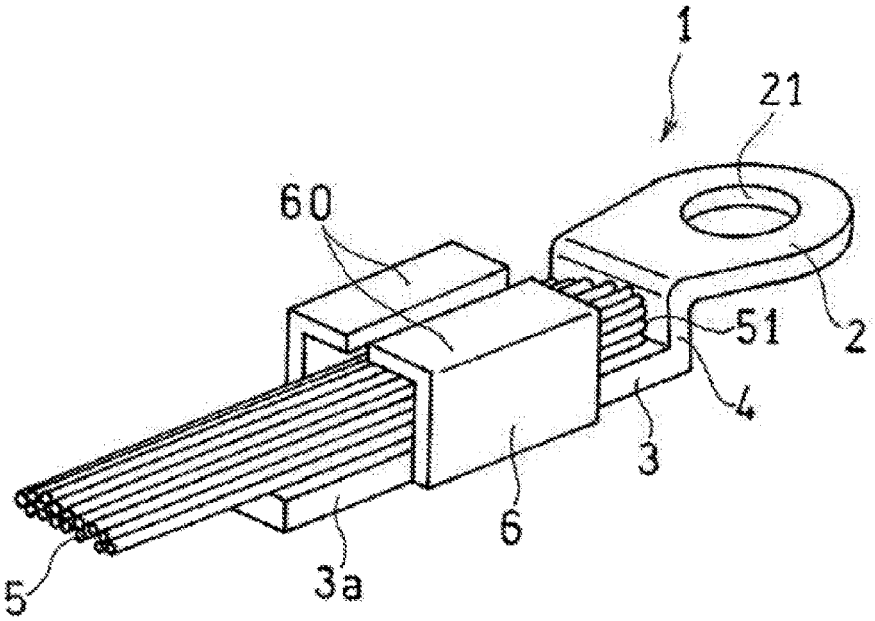
FIG. 2 is a perspective view of the electric cable connecting terminal to which an electric cable is attached.

FIG. 1 is an exploded perspective view of an electric cable connecting terminal of a first embodiment of the present invention to which an electric cable is not attached. FIG. 2 is a perspective view of the electric cable connecting terminal to which the electric cable is attached. The electric cable connecting terminal 1 is a terminal for electrically connecting the electric cable 5 to an external conductor (not shown). The electric cable 5 is a bundle of core wires, each comprised of a solid wire or a stranded wire made of, e.g., aluminum or an aluminum alloy. The electric cable connecting terminal 1 is comprised of a plate made of a different material (e.g., copper or a copper alloy such as brass), and a surface treatment for avoiding electric erosion is applied on at least a connecting surface thereof described later. In this embodiment, a tinning treatment is applied on the entire surface of the electric cable connecting terminal 1. Thus, the electric corrosion is avoided by the tinning treatment even if the electric cable connecting terminal 1 and the electric cable 5 are made of different materials.

The electric cable connecting terminal 1 includes: a connector portion 2 attached with a screw to an external conductor such as a terminal base (not shown) having a screw hole; and an electric cable connecting portion 3 having a connecting surface 3*b* to which the electric cable 5, a bundle of the core wires as described above, is connected by soldering (not shown). The connector portion 2 and the electric cable connecting portion 3 are aligned in the longitudinal direction X of the electric cable 5 shown in FIG. 1. In the center of the connector portion 2 located in front of the electric cable connecting portion 3, provided is an attachment hole 21 for attachment with a screw to the external conductor. The attachment hole 21 passes through in the vertical direction orthogonal to both of the principal surfaces. The electric cable connecting portion 3 includes a crimp portion 6 which is to be swaged to hold the electric cable 5. The crimp portion 6 of this embodiment includes two crimp pieces 60, 60. The crimp pieces 60, 60 protrude from both sides of the connecting surface 3*b* toward the connecting surface 3*b* on which the electric cable 5 is attached. The crimp pieces 60, 60 are thin protruding pieces formed out of the same member as the electric cable connecting portion 3. Note that only one crimp piece 60 may be provided. The connecting surface 3*b* of this embodiment extends from a back surface of a step portion 4 to rear ends of the two crimp pieces 60, 60. The two crimp pieces 60, 60 are swaged to hold the electric cable 5 to press the electric cable 5 onto the connecting surface 3*b*. In this state, the two crimp pieces 60, 60, the connecting surface 3*b*, and the electric cable 5 are soldered together.

The electric cable connecting terminal 1 of this embodiment includes the step portion 4 located between the connector portion 2 and the electric cable connecting portion 3 and protruding upward from the connecting surface 3*b*. In other words, as illustrated in FIG. 1, the step portion 4 protrudes toward the side where the electric cable 5 is soldered. That is, the step portion 4 protrudes in the direction in which the two crimp pieces 60, 60 of the crimp portion protrude. The step portion 4 stands upright orthogonal to the connecting surface 3*b* of the electric cable connecting portion 3. The step portion 4 is electrically and mechanically coupled to the connector portion 2 and the electric cable connecting portion 3, and is preferably integrally formed out of the same member as the connector portion 2 and the electric cable connecting portion 3 through a bending process. The electric cable connecting terminal 1 includes such a step portion 4, and the connector portion 2 protrudes from the connecting surface 3*b* of the electric cable connecting portion 3 where the electric cable 5 is soldered. This blocks the overflow of solder out of the electric cable connecting portion 3 to the connector portion 2 during soldering. This overcomes the disadvantage that the solder adheres to an upper surface of the connector portion 2. Moreover, when the electric cable 5 includes an end portion 51 that is in contact with the step portion 4 (or that is provided near the step portion 4) as illustrated in FIG. 2, the solder which has adhered to the end portion 51 of the electric cable 5 during soldering also adheres to the step portion 4. This can further strengthen the bond between the electric cable 5 and the electric cable connecting terminal 1.

In the electric cable connecting terminal 1 of this embodiment, the electric cable connecting portion 3 further includes an extending portion 3*a* extending backward opposite to the step portion 4 with respect to the crimp portion 6. The extending portion 3*a* is formed out of the same member as the electric cable connecting portion 3, but may be formed our of a different member therefrom. The extending portion 3*a* has a length that is approximately 30 to 50% of the entire length of the electric cable connecting portion 3 for example. In soldering, the solder may run along the attached electric cable 5 to overflow backward from the connecting surface 3*b* located between the two crimp pieces 60. However, the electric cable connecting portion 3 includes the extending portion 3*a* extending backward. This can avoid such overflow of the solder. In addition, the solder leaked from the connecting surface 3*b* to the extending portion 3*a* along the electric cable 5 further enhances the bonding strength between the electric cable's outer peripheral surfaces 5*a* and the electric cable connecting terminal 1. This further strengthens and stabilizes the mechanical junction between the electric cable connecting terminal 1 and the electric cable 5.

Figure 3:
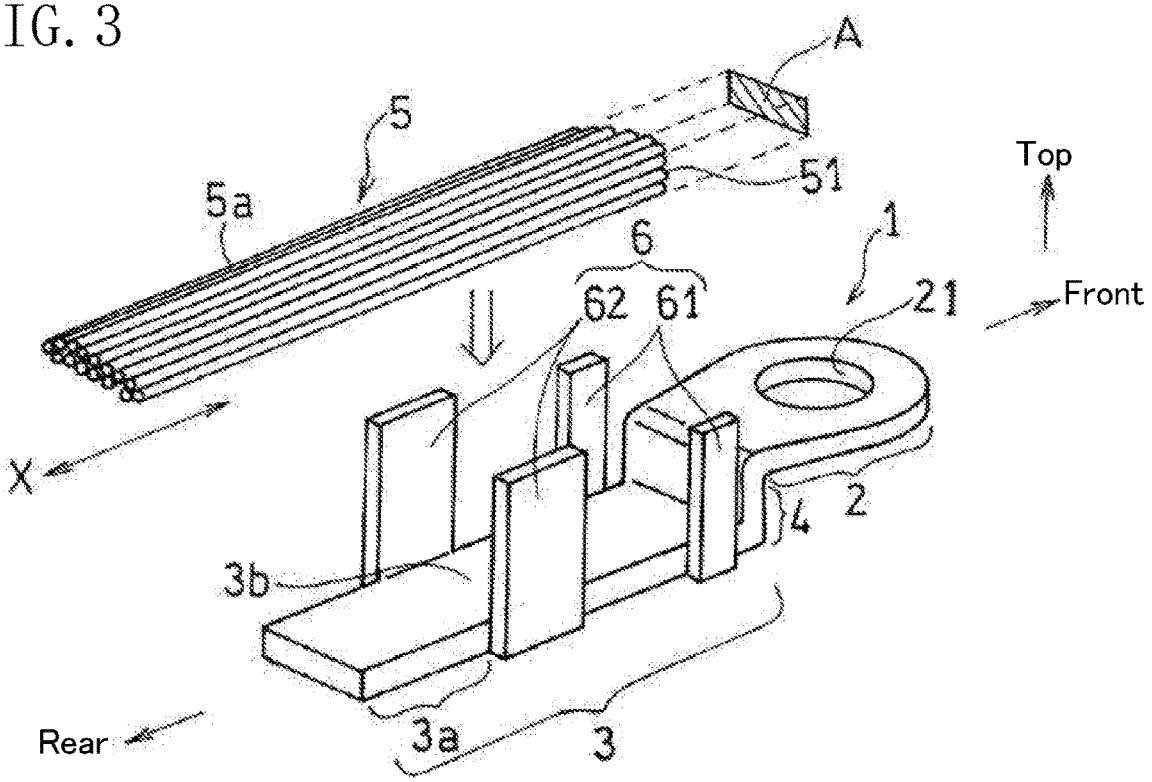
FIG. 3 is an exploded perspective view of an electric cable connecting terminal of a second embodiment of the present invention.
Figure 4:
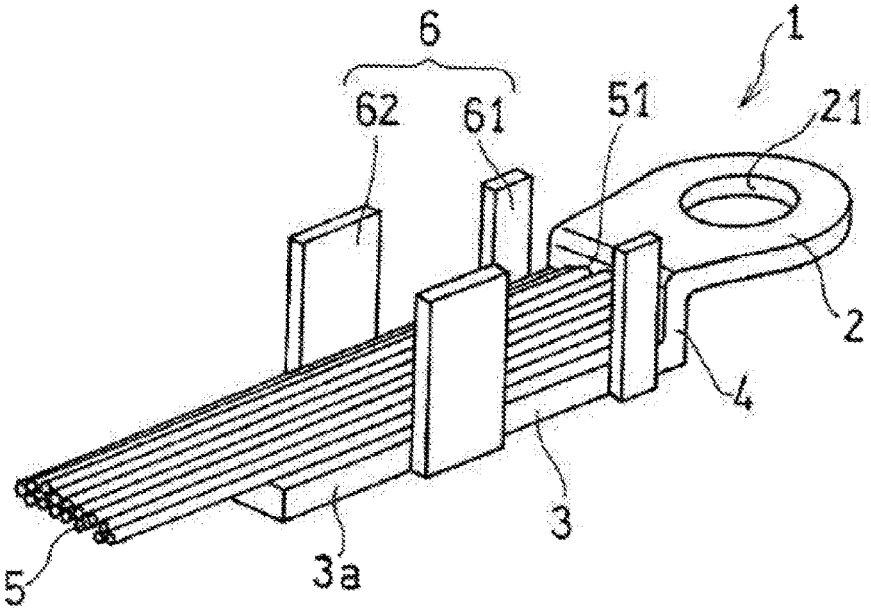
FIG. 4 is a perspective view of the electric cable connecting terminal to which an electric cable is attached.

FIG. 3 is an exploded perspective view of an electric cable connecting terminal of a second embodiment of the present invention to which an electric cable is not attached. FIG. 4 is a perspective view of the electric cable connecting terminal on which the electric cable is attached. Unlike the first embodiment, the electric cable connecting terminal 1 of this embodiment includes first crimp pieces 61 and second crimp pieces 62 as described below. In addition to the advantages of the first embodiment, the electric cable connecting terminal 1 of this embodiment can also achieve further advantages by the first crimp pieces 61, 61 and the second crimp pieces 62, 62. Thus, the first crimp pieces 61 and the second crimp pieces 62, a method for joining the electric cable connecting terminal 1 and the electric cable 5, and the further advantages mentioned above will be described. Here, similarly to the first embodiment, the electric cable connecting terminal 1 of this embodiment also includes a step portion 4 protruding from the connecting surface 3*b*, and further includes an extending portion 3*a* extending backward opposite to the step portion 4 with respect to the crimp portion 6.

The electric cable connecting portion 3 of this embodiment includes the crimp portion 6 having the two first crimp pieces 61, 61 and the two second crimp pieces 62, 62 which are thin protruding pieces formed out of the same member as the electric cable connecting portion 3. Note that both the crimp pieces 61, 62 may consist of one piece for each. The first and second crimp pieces 61, 62 are spaced apart with a given interval in the longitudinal direction X of the electric cable 5. The first crimp pieces 61 are arranged closer to the end portion 51 of the electric cable 5. Here, the connecting surface 3*b* extends from a back surface of a step portion 4 to rear ends of the two second crimp pieces 62, 62. The electric cable 5 is in contact with and soldered to the connecting surface 3*b*, and surrounded by the two swaged second crimp pieces 62. In this state, the electric cable 5 is soldered to and held by the second crimp pieces 62.

More specifically, the first crimp pieces 61, 61 are swaged to hold the electric cable 5 under a stress condition where a first external force is applied to the electric cable 5. The second crimp pieces 62, 62 are swaged to cover the electric cable 5 under a non-stress condition where no external force is applied to the electric cable 5. Here, under the stress condition where the first external force is applied by the first crimp pieces 61, 61, the electric cable connecting terminal 1 and the electric cable 5 are electrically joined. Also, under the non-stress condition of the second crimp pieces 62, 62, the electric cable connecting terminal 1 and the electric cable 5 are mechanically joined by soldering the electric cable 5 to the electric cable connecting terminal 1. This structure is implemented by swaging the first crimp pieces 61, 61 and electrically joining the electric cable connecting terminal 1 and the electric cable 5 under the stress condition where the first external force is applied to the electric cable 5 by the first crimp pieces 61, 61 as described above (an electrical joining step). Next, the second crimp pieces 62, 62 are swaged and brought closer to the electric cable 5 with no external force applied to the electric cable 5 as described above. In this state, a first heating electrode (described later) for heating the second crimp pieces 62, 62 is energized. Then, the electric cable 5 is heated under the non-stress condition. In this state, the above-described structure is implemented by supplying flux and solder to the electric cable 5 through a gap between the second crimp pieces 62, 62 and the electric cable 5, and mechanically joining the electric cable 5 to the electric cable connecting terminal 1 by soldering the electric cable 5 to the electric cable connecting terminal 1 (a mechanical joining step).

Figure 5:
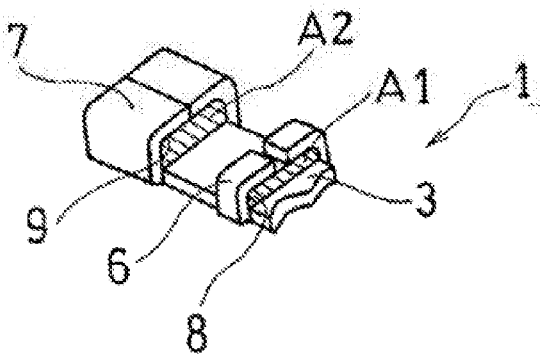
FIG. 5 is a perspective view of electric cable housing portions of the electric cable connecting terminal.

The first and second crimp pieces 61, 62 swaged as described above include electric cable housing portions 8, 9, respectively, into which the electric cable 5 is inserted as illustrated in FIG. 5. The electric cable housing portion 8 is surrounded by the first crimp pieces 61, 61 and the electric cable connecting portion 3. The electric cable housing portion 9 is surrounded by the second crimp pieces 62, 62 and the electric cable connecting portion 3 (the connecting surface 3*b*).

Figure 6:
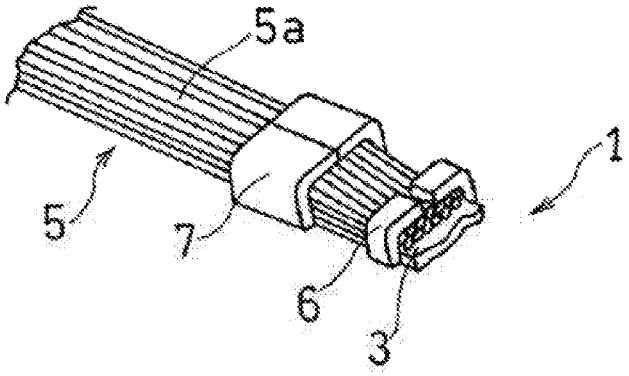
FIG. 6 is a perspective view of crimp pieces of the electric cable connecting terminal to which the electric cable is attached.

Compared with a cross-sectional area A (FIG. 3) of the electric cable 5 outside the electric cable housing portion 8, a cross-sectional area A1 of the electric cable housing portion 8 of the first crimp pieces 61 is smaller, where A1≤0.85A for example. In other words, an inner peripheral surface of the electric cable housing portion 8 of the first crimp pieces 61 and the outer peripheral surface 5*a* of the electric cable 5 in the electric cable housing portion 8 have no gap therebetween. That is, as illustrated in FIG. 6, the first crimp pieces 61, 61 are swaged to firmly press the electric cable 5 onto the upper surface of the electric cable connecting portion 3 to achieve the stress condition where the first crimp pieces 61, 61 apply the first external force to the electric cable 5. Accordingly, the core wires in the electric cable 5 come into close contact with each other with no gap left therebetween and come to have their bonding density increased, and thus the terminal 1 and the electric cable 5 are joined in an electrically stable manner. Note that the electric cable 5 made of aluminum or an aluminum alloy has a tip portion from which an oxide film is removed in advance, and the tip end is crimped by the first crimp pieces 61, 61.

Figure 7:
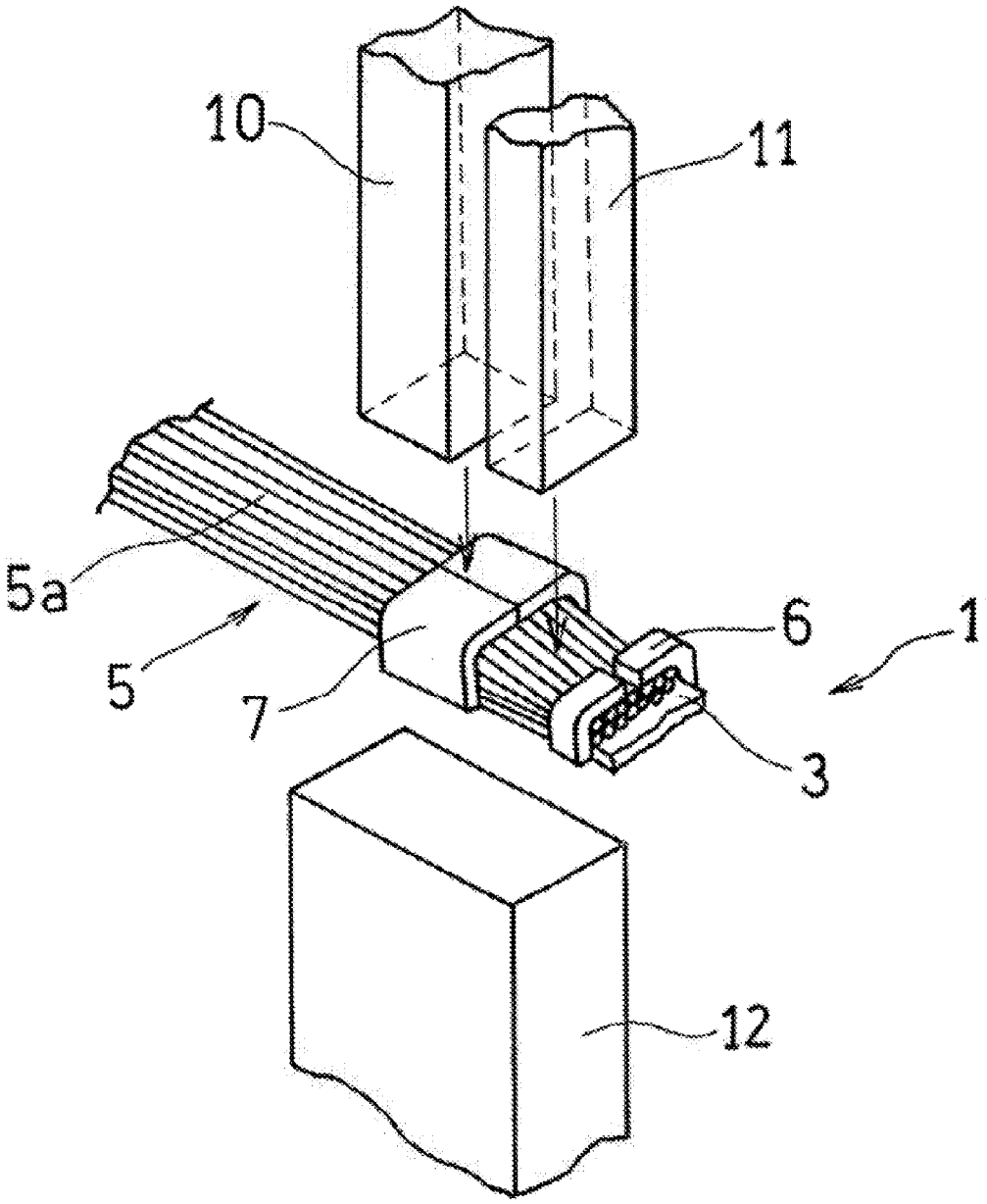
FIG. 7 is a perspective view for describing a method for joining the electric cable connecting terminal and the electric cable of the second embodiment of the present invention.

Here, the second crimp pieces 62, 62 are soldered to the electric cable 5 by using an electrode for fusing welding as illustrated in FIG. 7 for example. The heating electrode such as the fusing welding electrode is made of tungsten for example, and includes two upper electrodes 10, 11 and one lower electrode 12. The electric cable 5 and the electric cable connecting terminal 1 are sandwiched vertically between the upper electrodes 10, 11 and the one lower electrode 12, and then the electrodes are energized to be heated. The upper electrode 10 and the lower electrode 12 constitute a first heating electrode, and the upper electrode 11 and the lower electrode 12 constitute a second heating electrode.

The electric cable 5 crimped by the first crimp pieces 61, 61 has some mechanical strength. Thus, in fusing welding, the first crimp pieces 61, 61 swaged before the second crimp pieces 62, 62 are swaged hold and temporarily secure the electric cable connecting terminal 1 so that the electric cable connecting terminal 1 does not drop off the electric cable 5. After the second crimp pieces 62, 62 are swaged and the electric cable 5 is soldered, the second crimp pieces 62, 62 mainly bears the mechanical strength whereas the first crimp pieces 61, 61 hardly bears the mechanical load and mainly bears the electrical junction.

Referring back to FIG. 5, compared with the cross-sectional area A (FIG. 3) of the electric cable 5 outside the electric cable housing portion 8, a cross-sectional area A2 of the electric cable housing portion 9 of the second crimp pieces 62 is larger, where 1.01A≤A2≤1.05A for example. In other words, an inner peripheral surface of the electric cable housing portion 9 of the second crimp pieces 62 and the outer peripheral surface 5*a* of the electric cable 5 in the electric cable housing portion 9 have a gap therebetween or are in slight contact with each other. At this time, the crimp swaged with no external force applied to the electric cable 5, so as to be brought closer to the electric cable 5. Then, the first heating electrodes 10, 12 in FIG. 7 are energized with the amount of current supplied and the timing controlled appropriately to heat the electric cable 5 under the non-stress condition. In this state, the flux and solder are supplied to the electric cable 5 through the gap between the second crimp pieces 62, 62 to solder the electric cable 5 to the electric cable connecting terminal 1.

In this case, the electric cable 5 is not fixed by the second crimp pieces 62, 62 firmly swaged, but covered by the second crimp pieces 62, 62 lightly bent along the outer shape of the bundle of the core wires. In this time, the inner peripheral surface of the second crimp pieces 62, 62 and the outer peripheral surface 5*a* of the electric cable 5 have a gap therebetween (the non-stress condition) to the point where the electric cable 5 does not come loose in the electric cable connecting portion 3. Here, the flux and solder are supplied through the gap. Thus, the electric cable 5 made of e.g., aluminum that snaps off easily is prevented from snapping off, and the proper soldering is achieved.

In addition, the flux and solder spreading to the entirety of the outer peripheral surface 5*a* of the electric cable 5 increase the bonding strength between the outer peripheral surfaces 5*a* of the electric cable 5 and the electric cable connecting terminal 1. Thus, the electric cable connecting terminal 1 and the electric cable 5 are mechanically firmly joined. At this time, the flux and solder do not penetrate into the electric cable 5, but penetrate into the gaps among the large number of core wires near the outer peripheral surface 5*a* of the electric cable 5. That is, the second crimp pieces 62, 62 and the electric cable 5 have a low electrical bonding density therebetween, but mainly bear the mechanical strength.

Further, in the mechanical joining step, as illustrated in FIG. 7, the electric cable 5 between the first and second crimp pieces 61, 62 is sandwiched and pressed with a second external force applied between the upper electrode 11 and the lower electrode 12 of the second heating electrode such that the electrodes 11, 12 are energized to heat the electric cable 5 under the stress condition where the second external force is applied. In this state, the flux and solder are supplied to the gap between the second crimp pieces 62, 62 and the electric cable 5 and then flow to the electric cable 5 between the crimp pieces 61, 62. With such flux and solder, the core wires of the electric cable 5 between the crimp pieces 61, 62 are soldered such that the terminal 1 and the electric cable 5 can be more firmly mechanically joined. Here, part of the flux and solder also flows to the electric cable 5 in the first crimp pieces 61, 61 to solder the core wires such that the mechanical junction strength can be improved. Here, the energization of the upper electrode 10 and the lower electrode 12 and the energization of the upper electrode 11 and the lower electrode 12 may be conducted at the same time or at different times.

In this embodiment, the electric cable connecting terminal 1 and the electric cable 5 are made of different materials. Thus, as stated above, the electric cable connecting terminal 1 is given a surface treatment (the tinning treatment) for avoiding the electric corrosion with the electric cable 5. For example, Patent Document 1 discloses a typical solder less connecting structure with improved anti-electric erosion capability, functioning as a water sealing structure formed by solderless-connecting aluminum wires to copper terminal fittings, and then treating the entire solderless connected portion by a hot melt molding process. Also, for example, Japanese Unexamined Patent Publication No. 2000-277325 discloses a typical terminal structure in which a pre-insulated coated electric cable is sandwiched, heated, and pressed between heating electrodes (e.g., fusing welding electrodes or resistance welding electrodes) to be melted and joined to the terminal. If an electric cable made of e.g., aluminum is solderless-connected to a terminal under pressure and heat as in the above structures, the electric cable may snap off under pressure because the electric cable has lower strength than an electric cable made of e.g., copper. In other words, such a terminal structure has weak mechanical junction. In addition, it was also necessary to make the terminal and the electric cable conductive to stabilize electrical bonding. Also, the above-described water sealing structure for anti-electric corrosion causes an increase in the number of steps for joining the terminal to the electric cable, and also complicates the terminal structure. However, in this embodiment, even if the electric cable connecting terminal 1 and the electric cable 5 are made of different materials as described above, the simple structure can avoid the generation of electric corrosion and also can avoid a significant increase in the number of steps. Thus, the electric cable 5 and the electric cable connecting terminal 1 can be mechanically firmly joined, and can also be joined in an electrically stabilized state.

Figure 8:
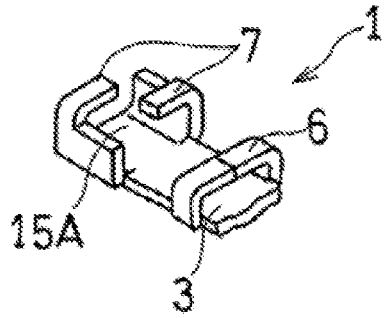
FIG. 8 is a perspective view of a first variation of the second crimp pieces of the second embodiment.
Figure 9:
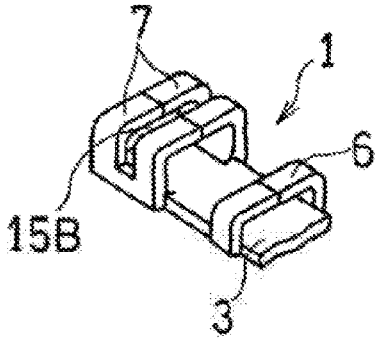
FIG. 9 is a perspective view of a second variation of the second crimp pieces of the second embodiment.
Figure 10:
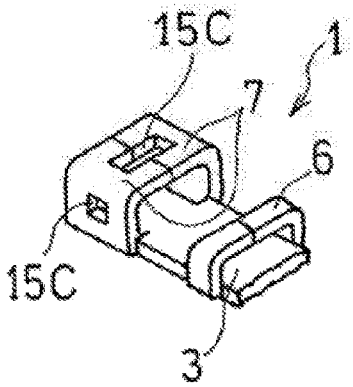
FIG. 10 is a perspective view a third variation of the second crimp pieces of the second embodiment.

FIGS. 8 to 10 are perspective views of first to third variations of the second crimp pieces 62 of the second embodiment. In the first to third variations, the second crimp pieces 62 are provided with one or more through portions 15 (15A to 15C) passing through the crimp pieces 62 in a direction orthogonal to the electric cable 5. The configurations of the members other than the crimp pieces 62 are the same as those of the second embodiment. Here, in FIGS. 8 to 10, the connector portion 2, the step portion 4, and the extending portion 3*a* are omitted for the sake of clarity.

As illustrated in FIG. 8, in the first variation, the second crimp pieces 62, 62 each have a crest surface through which a through portion 15A is cut so that, in plan view, the second crimp pieces 62, 62 each are generally L-shaped. As illustrated in FIG. 9, in the second variation, the second crimp pieces 62, 62 each have a crest surface and a side surface through which a slit through portion 15B is cut. As illustrated in FIG. 10, in the third variation, the second crimp pieces 62, 62 each have a crest surface and a side surface through which through portions 15C are cut. Specifically, the second crimp piece 62 has the crest surface through which a slit through portion is cut, and the side surface through which a through portion (a through hole) is cut. In the variations, the through portions allow the fusing welding electrode 10 to make direct contact with the electric cable 5. That is, in the variations, the second crimp piece 62 includes the through portion 15 allowing the flux and solder to flow smoothly, and also allowing heat to be transferred from the fusing welding electrodes 10, 12 to the electric cable 5 easily.

Figure 11:
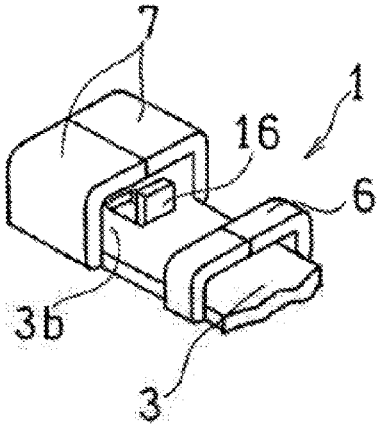
FIG. 11 is a perspective view of a variation of the electric cable connecting portion of the embodiments.

Also, like a variation in FIG. 11, the electric cable connecting portion 3 may be provided with a protruding portion 16 (such as an upright cut member formed by cutting out a section of a plate and making the section stand upright) protruding from the connecting surface 3*b* of the second embodiment. The protruding portion 16 can also be provided in the first embodiment. That is, the protruding portion 16 brings the core wires closer to the inner peripheral surface of the second crimp piece 62 to increase the area of contact between the second crimp piece 62 and the core wires. This allows heat to be transferred easily from the fusing welding electrodes into the gaps between the core wires.

While the preferred embodiments have been described above with reference to the drawings, the present invention is not limited to the above embodiments. The skilled person would easily arrive at various additions, modifications, or deletions with reference to the specification of the present application, without departing from the true spirit and scope of the present invention and the equivalents thereof. Thus, those alternative embodiments should be construed to fall within the scope of the present invention defined by the claims or the equivalents thereof. For example, while aluminum or an aluminum alloy is used for the electric cable in the above embodiments, magnetic plated wires (FPW) or copper-clad aluminum wires (CCAW) can be also used for the electric cable. The FPW is formed by coating an aluminum or copper stranded wire with a ferromagnetic thin film layer, for example, to reduce the proximity effect at the time of high frequency current. The CCAW is lightweight and has, e.g., an improved tensile strength and bending strength. In short, the above embodiments are suitable for the joint between the electric cable and electric cable connecting terminal each made of different materials. In that case, it is more preferable to apply the treatment for avoiding electric corrosion. While the fusing welding electrode is used as a heating electrode to heat the electric cable, a resistance welding electrode may also be used to heat the electric cable. Such configurations also fall within the scope of the present invention.

The invention claimed is:

1. An electric cable connecting terminal for electrically connecting an electric cable to an external conductor, the electric cable connecting terminal comprising:

a connector portion to be attached to the conductor, and an electric cable connecting portion having a connecting surface to which an electric cable, which is a bundle of core wires, is connected by soldering, wherein the electric cable connecting portion includes: a crimp portion to be swaged to hold the electric cable; and a step portion protruding from the connecting surface between the connector portion and the crimp portion, and wherein a solder adhered to the end portion of the electric cable adheres to the step portion.

2. The electric cable connecting terminal of claim 1, wherein the electric cable connecting portion further includes an extending portion extending opposite to the step portion with respect to the crimp portion.

3. The electric cable connecting terminal of claim 1, wherein the electric cable is made of aluminum or an aluminum alloy, the electric cable connecting terminal is made of copper or a copper alloy which is a material different from that of the electric cable, and a tinning treatment for avoiding electric corrosion is applied on at least the connecting surface.

4. The electric cable connecting terminal of claim 1, wherein the crimp portion includes a first crimp piece to be swaged to hold the electric cable under a stress condition where a first external force is applied, and a second crimp piece to be swaged to cover the electric cable under a non-stress condition where no external force is applied, both the crimp pieces are spaced apart with a predetermined gap in a longitudinal direction of the electric cable connecting portion, under the stress condition where the first external force is applied by the first crimp piece, the electric cable connecting terminal and the electric cable are electrically joined, and under the non-stress condition of the second crimp piece, the electric cable connecting terminal and the electric cable are mechanically joined by soldering.

5. The electric cable connecting terminal of claim 4, wherein the first and second crimp pieces swaged each include an electric cable housing portion into which the electric cable is inserted, a cross-sectional area of the electric cable housing portion of the first crimp piece is smaller than that of the electric cable outside the electric cable housing portion, and a cross-sectional area of the electric cable housing portion of the second crimp piece is larger than that of the electric cable outside the electric cable housing portion.

6. The electric cable connecting terminal of claim 4, wherein the second crimp piece includes one or more through portions passing through the second crimp piece in a direction orthogonal to the electric cable.

7. The electric cable connecting terminal of claim 4, wherein the electric cable connecting portion includes a protruding portion protruding from the connecting surface.

8. A method for joining an electric cable to the electric cable connecting terminal of claim 4, the method comprising:

an electrical joining step of swaging the first crimp piece and electrically joining the electric cable connecting terminal and the electric cable under the stress condition where the first external force is applied to the electric cable by the first crimp piece, and a mechanical joining step of swaging and bringing the second crimp piece toward the electric cable with no external force applied to the electric cable; energizing a first heating electrode for heating the second crimp piece; heating the electric cable under the non-stress condition, supplying flux and solder to the electric cable through a gap between the second crimp piece and the electric cable; and mechanically joining the electric cable and the electric cable connecting terminal by soldering the electric cable to the electric cable connecting terminal.

9. The method of claim 8, wherein the mechanical joining step includes:

heating the electric cable between the first crimp piece and the second crimp piece with a second external force applied thereto by a second heating electrode; and using the flux and solder supplied to the gap and flowed to the electric cable to solder the core wires of the electric cable between both the crimp pieces.

* * * * *